US008408884B2

(12) United States Patent
Hsu et al.

(10) Patent No.: US 8,408,884 B2
(45) Date of Patent: Apr. 2, 2013

(54) FAN AND AIRFLOW GUIDING STRUCTURE THEREOF

(75) Inventors: Chia-Ming Hsu, Taoyuan Hsien (TW); Shun-Chen Chang, Taoyuan Hsien (TW); Li-Chen Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 500 days.

(21) Appl. No.: 12/429,800

(22) Filed: Apr. 24, 2009

(65) Prior Publication Data

US 2009/0269196 A1 Oct. 29, 2009

(30) Foreign Application Priority Data

Apr. 25, 2008 (TW) ..... 97115315 A
Mar. 11, 2009 (TW) ..... 98107835 A
Mar. 11, 2009 (TW) ..... 98107836 A

(51) Int. Cl.
*F04B 35/04* (2006.01)

(52) U.S. Cl. ..... 417/423.1

(58) Field of Classification Search ..... 417/423.1; D23/411
See application file for complete search history.

(56) References Cited

U.S. PATENT DOCUMENTS 5,730,583 A * 3/1998 Alizadeh ..... 416/189
6,196,300 B1 * 3/2001 Checchetti ..... 165/80.3
2006/0228237 A1 * 10/2006 Winkler ..... 417/423.1
2007/0080604 A1 4/2007 Yang et al.
2008/0075585 A1 * 3/2008 Acre ..... 415/177
2010/0232957 A1 * 9/2010 Horng ..... 415/208.1

FOREIGN PATENT DOCUMENTS

CN 2406092 11/2000
CN 2864177 1/2007
JP 2001-140798 5/2001
JP 2002-257095 9/2002

* cited by examiner

*Primary Examiner* — Anh Mai
*Assistant Examiner* — Michael Santonocito
(74) *Attorney, Agent, or Firm* — Muncy, Geissler, Olds & Lowe, PLLC

(57) ABSTRACT

A fan includes an airflow guiding structure, an impeller and a guiding ring. The outer radius of the airflow guiding structure increases gradually from the top of the airflow guiding structure to the bottom of the airflow guiding structure. The airflow guiding structure includes a plurality of fins and a first space for accommodating a circuit device. The impeller is disposed on the airflow guiding structure and has a hub and several blades. The guiding ring connects to the airflow guiding structure via at least one connecting element. A predetermined distance is arranged between the inner surface of the guiding ring and the outer edges of the blades. An inlet is formed at the top of the guiding ring, and an outlet is formed between the bottom of the guiding ring and the outer surface of a sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet.

19 Claims, 13 Drawing Sheets

FAN AND AIRFLOW GUIDING STRUCTURE THEREOF

CROSS REFERENCE TO RELATED APPLICATIONS

This Non-provisional application claims priorities under 35 U.S.C. §119(a) on Patent Application No(s). 097115315, filed in Taiwan, Republic of China on Apr. 25, 2008, Patent Application No(s). 098107835, filed in Taiwan, Republic of China on Mar. 11, 2009, and Patent Application No(s). 098107836, filed in Taiwan, Republic of China on Mar. 11, 2009, the entire contents of which are hereby incorporated by reference.

BACKGROUND OF THE INVENTION

1. Field of Invention

The present invention relates to a fan and in particular to a fan and an airflow guiding structure thereof that can change the direction of the airflows of the fan.

2. Related Art

Since the performance of the electronic apparatuses has been improved, the heat dissipation device or system becomes one of the indispensable equipments of the electronic apparatuses. If the heats generated by the electronic apparatus can not be dissipated properly, the performance thereof may become worse and, even more, the electronic apparatus may be burnt out. As for the micro electronic devices such as the integrated circuits (ICs), the dissipation device is much more important. In view of the integrated density of the ICs being increasing and the progress of the packaging technology, the size of the ICs becomes smaller, and the heat accumulated in per unit area of the integrated circuits become higher. Therefore, the heat dissipation device with high heat dissipation efficiency has become one of the most important development areas in the electronic industry.

Fan is the most popular heat dissipation device in the present heat dissipation technology. According to the directions of the airflow entering and exiting from the fan, the fan can be classified to axial-flow fans and centrifugal fans.

In an axial-flow fan, the airflow enters the conventional axial-flow fan through the inlet and then exits through the outlet. The airflow direction entering into the inlet is roughly parallel to the airflow direction exiting from the outlet. On the other hand, in a centrifugal fan, the airflow enters the conventional centrifugal fan through the inlet and then exits through the outlet. The airflow direction entering into the inlet is roughly perpendicular to the airflow direction exiting from the outlet. Compared to the axial-flow fan, although the centrifugal fan can change the airflow direction, the centrifugal fan has the drawbacks of lower performance, lower airflow quantity and louder noise. Moreover, the centrifugal fan is hard to provide a multi-function fan in the current trend towards small size.

SUMMARY OF THE INVENTION

The present invention is to provide a fan and an airflow guiding structure thereof that can change the airflow direction of the conventional axial-flow fan as well as keeping the advantages of the conventional axial-flow fan such as high performance, large air quantity and low noise.

Furthermore, the present invention is to provide a fan and an airflow guiding structure thereof that can conduct heats away from a heat source by a plurality of fins of the airflow guiding structure, so as to enhance the heat dissipating efficiency of the fan.

Moreover, the present invention is to provide a fan and an airflow guiding structure thereof that has a first space for accommodating an exterior circuit device so as to economize the use of space, and the circuit device can be protected under the airflow guiding structure.

To achieve the above, the present invention discloses a fan including an airflow guiding structure, an impeller and a guiding ring. The outer radius of the airflow guiding structure increases gradually from the top of the airflow guiding structure to the bottom of the airflow guiding structure. The impeller is disposed on the airflow guiding structure and has a hub and a plurality of blades disposed around the hub. The guiding ring is connected to the airflow guiding structure via at least one connecting element. A predetermined distance is arranged between an inner surface of the guiding ring and outer edges of the blades. An inlet is formed at the top of the guiding ring, and an outlet is formed between the bottom of the guiding ring and an outer surface of a sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet. Furthermore, the airflow guiding structure is composed of a plurality of fins, and a first space is disposed in the airflow guiding structure for accommodating a circuit device.

In addition, the present invention also discloses a fan including an airflow guiding structure, an impeller and a guiding ring. The outer radius of the airflow guiding structure increases gradually from the top of the airflow guiding structure to the bottom of the airflow guiding structure. The impeller is disposed on the airflow guiding structure and has a hub and a plurality of blades disposed around the hub. The guiding ring is connected to a module housing. A predetermined distance is arranged between an inner surface of the guiding ring and outer edges of the blades. An inlet is formed at the top of the guiding ring, and an outlet is formed between the bottom of the guiding ring and an outer surface of a sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet.

To achieve the above, the present invention further discloses an airflow guiding structure applied to an axial-flow fan. The axial-flow fan includes an impeller and a guiding ring. The impeller has a hub and a plurality of blades disposed around the hub. The airflow guiding structure is disposed underneath the impeller. The outer radius of the airflow guiding structure increases gradually from the top of the airflow guiding structure to the bottom of the airflow guiding structure. The guiding ring is connected to the airflow guiding structure via at least one connecting element. A predetermined distance is arranged between an inner surface of the guiding ring and outer edges of the blades. An inlet is formed at the top of the guiding ring, and an outlet is formed between the bottom of the guiding ring and an outer surface of a sidewall of the airflow guiding structure. When the impeller rotates, the airflow enters the fan from the inlet and flows along the outer surface of the sidewall of the airflow guiding structure, and then the airflow exits the fan through the outlet.

The direction of the airflow passing through the outlet is different from the direction of the airflow passing through the inlet.

In addition, the present invention also discloses an airflow guiding structure applied to an axial-flow fan. The axial-flow fan includes an impeller and a guiding ring, the impeller having a hub and a plurality of blades disposed around the hub. The airflow guiding structure is disposed underneath the impeller. The outer radius of the airflow guiding structure increases gradually from the top of the airflow guiding structure to the bottom of the airflow guiding structure. The airflow guiding structure is connected to a module housing. A predetermined distance is arranged between an inner surface of the guiding ring and outer edges of the blades. An inlet is formed at the top of the guiding ring, and an outlet is formed between the bottom of the guiding ring and an outer surface of a sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet.

As mentioned above, in the fan of the present invention, the outer radius of the airflow guiding structure increases gradually from the top of the airflow guiding structure to the bottom of the airflow guiding structure. Thus, the direction of the airflow can be changed when the airflow flows along the outer surface of the sidewall of the airflow guiding structure and then exits the fan. Furthermore, the airflow guiding structure is composed of a plurality of fins, and a first space is disposed in the airflow guiding structure for accommodating a circuit device. Compared with the prior art, the present invention can not only change the direction of the airflow exiting from the fan, but also keeps the advantages of high performance, large quantity of exiting airflow and low noise. Moreover, the present invention enhances the heat dissipating efficiency of the fan and economizes the use of space by the structure of the airflow guiding structure.

BRIEF DESCRIPTION OF THE DRAWINGS

The present invention will be fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
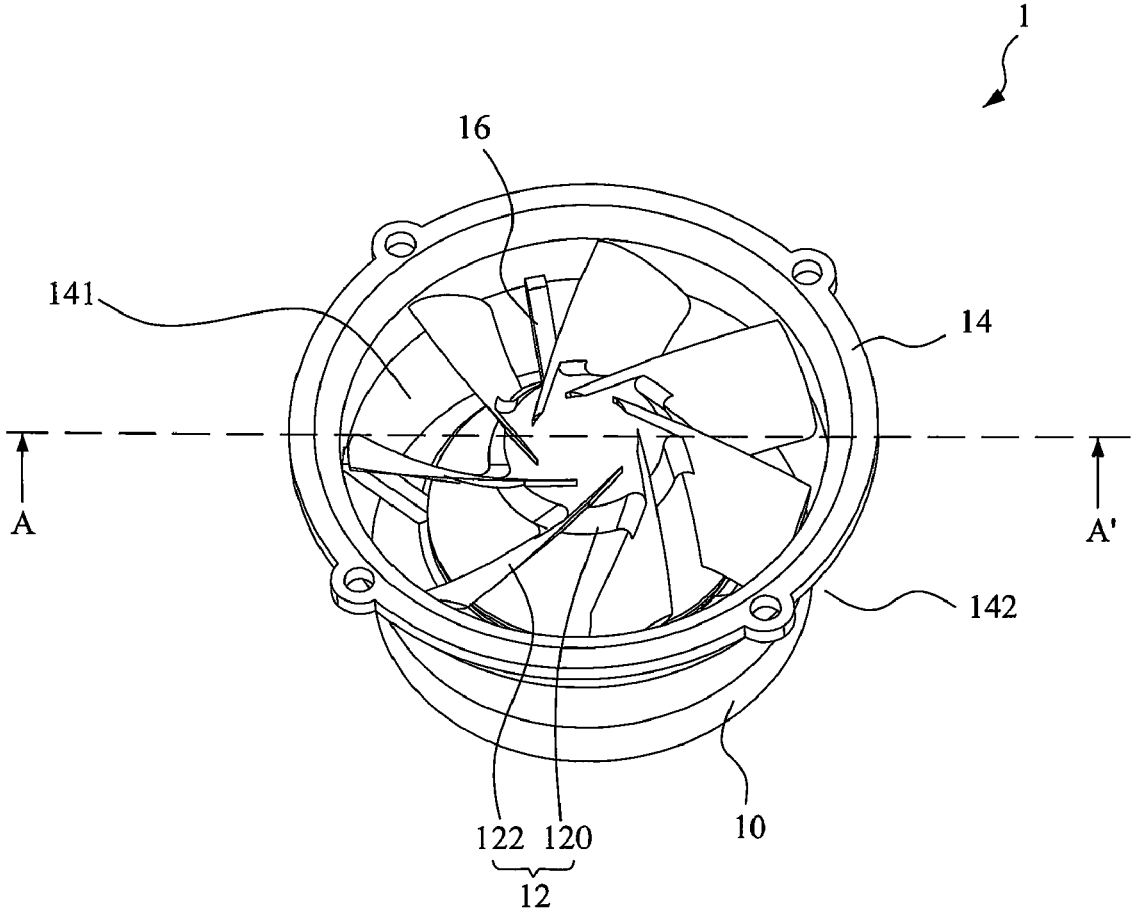
FIG. 1A is a three-dimensional illustration showing a fan according to a first embodiment of the present invention.
Figure 1B:
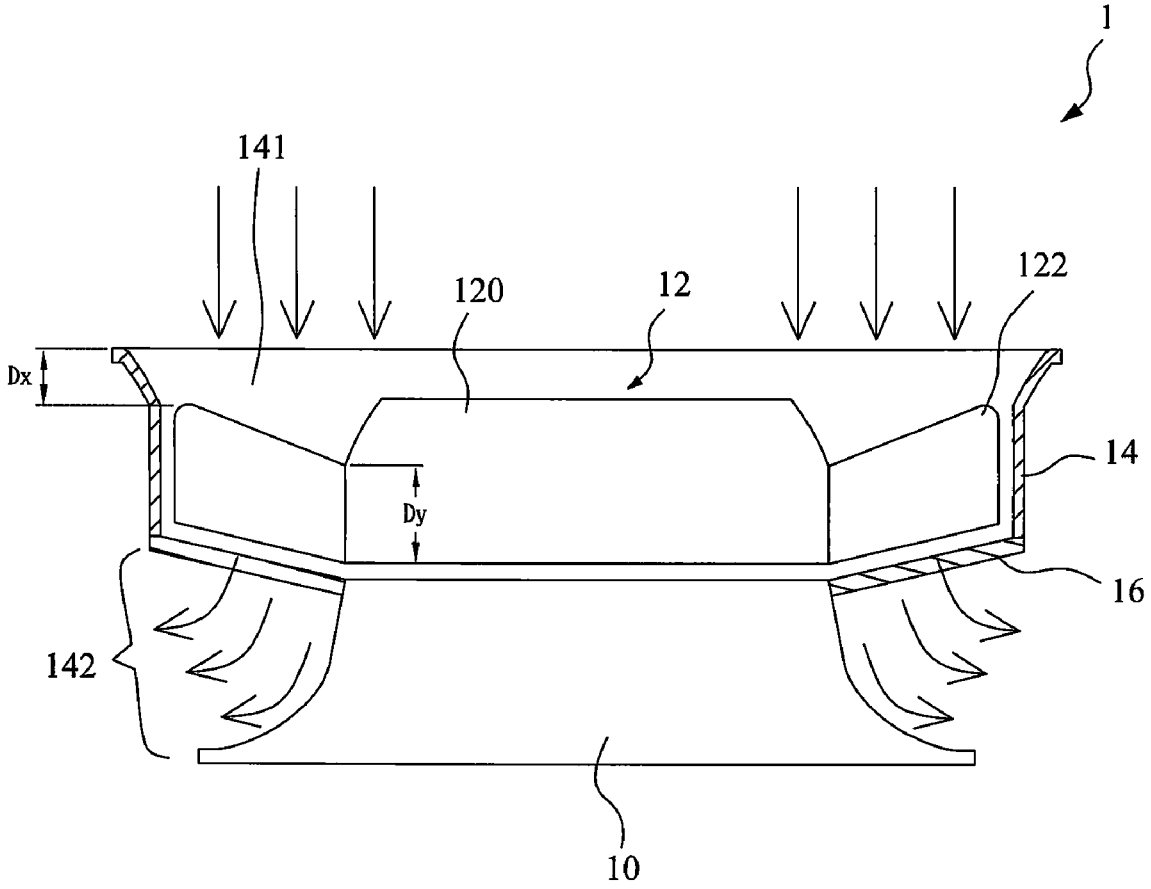
FIG. 1B is a sectional view of the fan along line A-A' of FIG. 1A.

Please refer to FIG. 1A and FIG. 1B, a fan 1 according to a first embodiment of the present invention includes an airflow guiding structure 10, an impeller 12 and a guiding ring 14.

The outer radius of the airflow guiding structure 10 increases gradually from the top of the airflow guiding structure 10 to the bottom of the airflow guiding structure 10, so that the outer surface of the airflow guiding structure 10 forms at least one curved surface. The impeller 12 is disposed over the airflow guiding structure 10. The impeller 12 has a hub 120 and a plurality of blades 122 disposed around the hub 120. A motor (not shown) is disposed within the hub 120. The outer radius of the hub 120 increases gradually from the top of the hub 120 to the center of the hub 120. Preferably, a ratio of the outer radius of the bottom of the airflow guiding structure 10 to the outer radius of the bottom of the hub 120 ranges from 1.3 to 3.

The guiding ring 14 is connected to the airflow guiding structure 10 via a plurality of connecting elements 16. A predetermined distance is arranged between the inner surface of the guiding ring 14 and the outer edges of the blades 122. An inlet 141 is formed at the top of the guiding ring 14, and an outlet 142 is formed between the bottom of the guiding ring 14 and the outer surface of the sidewall of the airflow guiding structure 10. The diameter of the guiding ring 14 decreases gradually from the top of the guiding ring 14 to a portion of the guiding ring 14 adjacent to the top of the blade 122, so as to guide more airflows into the fan 3 through the inlet 141. A first predetermined distance "Dx" is defined between the top of the guiding ring 14 and the top of the blades 122. The conjunction of the blades 122 and the hub 120 has a length "Dy". The ratio of "Dx" to "Dy" ranges from 0.3 to 1. With regard to the external appearance, the fan 3 of the present invention can be classified as an axial-flow fan.

When the motor drives the impeller 12 to rotate (the guiding ring 14 is not rotated), the airflow enters the fan 3 from the inlet 141 and flows along the outer surface of the sidewall of the airflow guiding structure 10, then the airflow exits the fan 3 through the outlet 142. Thus, the direction of the airflow passing through the outlet 142 is different from the direction of the airflow passing through the inlet 141. In the embodiment, the direction of the airflow passing through the outlet 142 is roughly perpendicular to the direction of the airflow passing through the inlet 141, this is similar to the conventional centrifugal fan. Furthermore, the shape of the airflow guiding structure 10 can minimize the air pressure loss while changing the airflow direction.

Figure 2A:
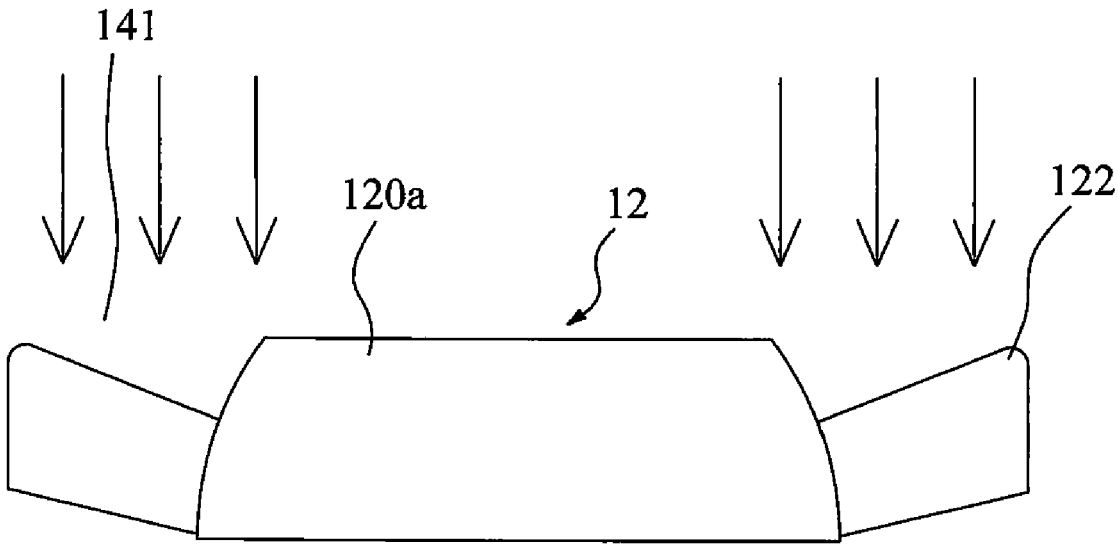
FIG. 2A and FIG. 2B show another two embodiments of the hub of FIG. 1A of the present invention.
Figure 2B:
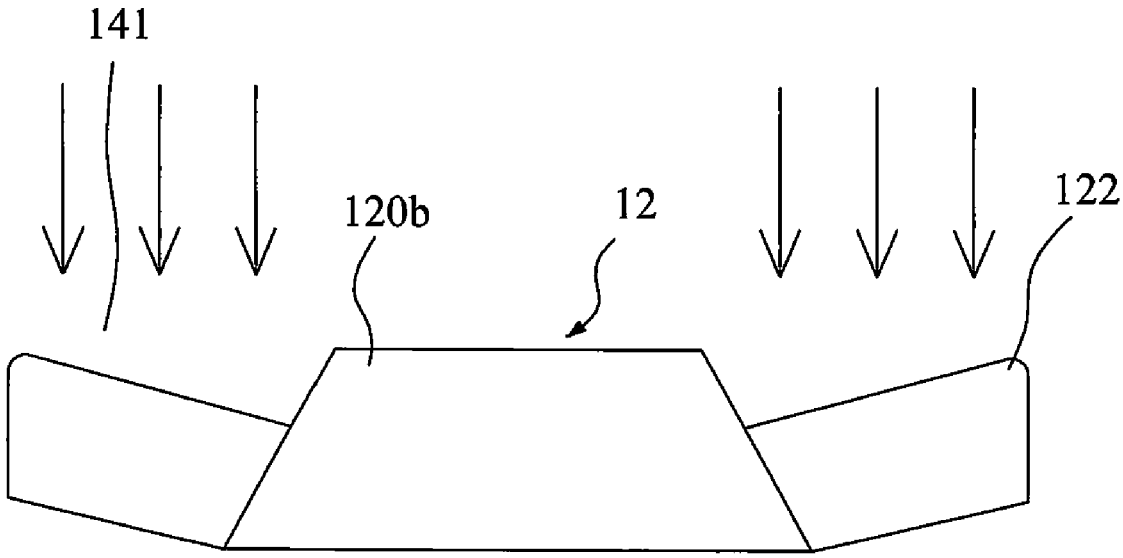

Please refer to FIG. 2A and FIG. 2B, which show another two embodiments of the hub of FIG. 1A of the present invention. The outer radius of the hub 120*a* of FIG. 2A increases gradually from the top of the hub 120*a* to the bottom of the hub 120*a*, so that the outer surface of the hub 120*a* forms at least one curved surface for guiding the airflow smoothly. The outer radius of the hub 120*b* of FIG. 2B increases gradually from the top of the hub 120*b* to the bottom of the hub 120*b*, so that the outer surface of the hub 120*b* forms at least one inclined surface.

Figure 3A:
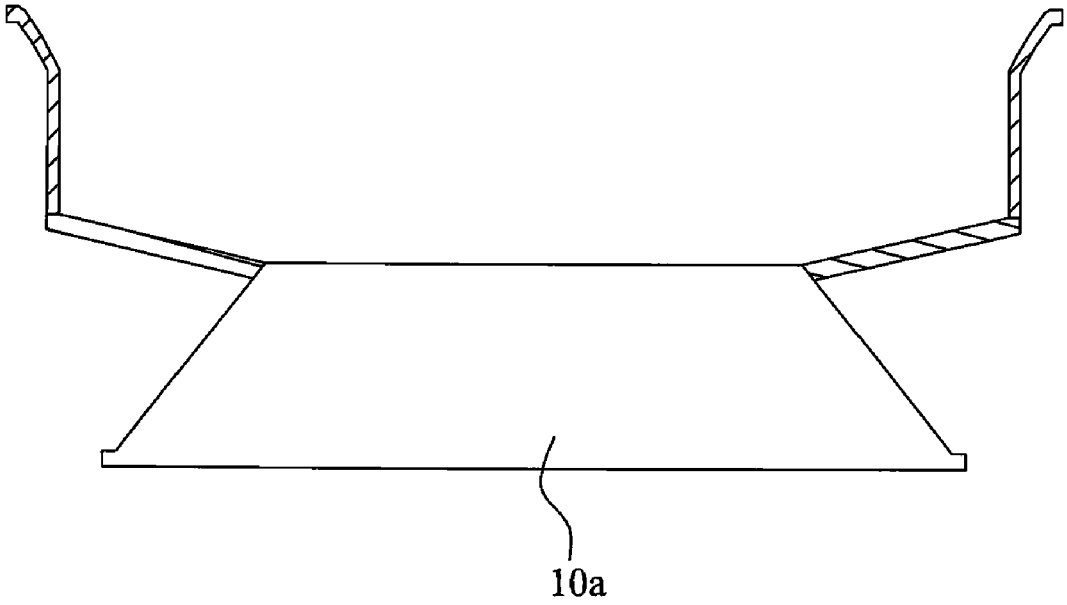
FIG. 3A and FIG. 3B show another two embodiments of the airflow guiding structures of FIG. 1A of the present invention.
Figure 3B:
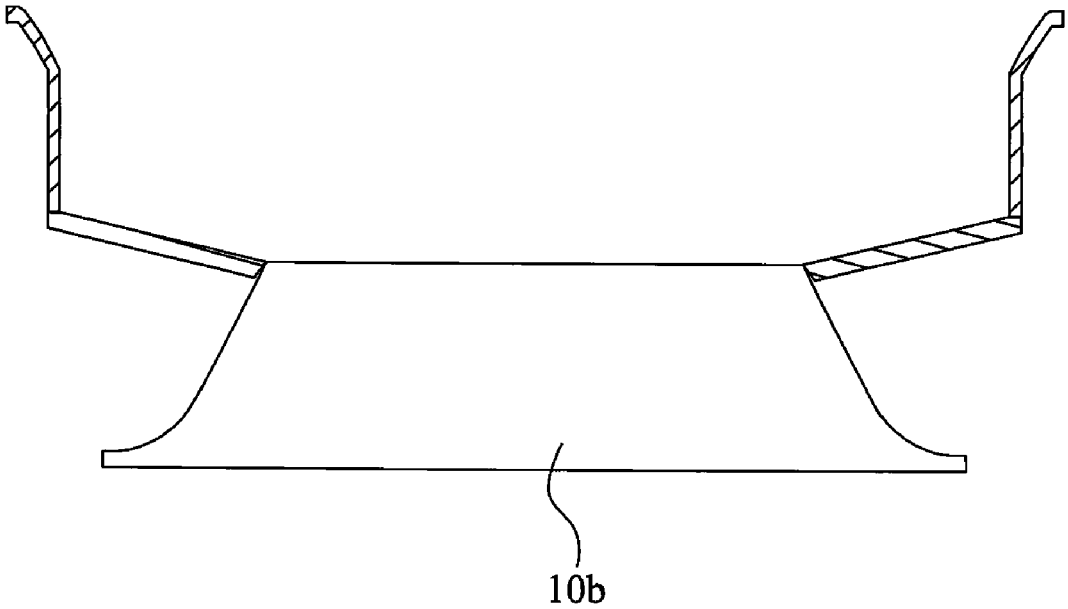

Please refer to FIG. 3A and FIG. 3B, which show two embodiments of the airflow guiding structures of the present invention. The outer radius of the airflow guiding structure 10*a* increases gradually from the top of the airflow guiding structure 10*a* to the bottom of the airflow guiding structure 10*a*, so that the outer surface of the airflow guiding structure 10*a* forms at least one inclined surface. The outer radius of the airflow guiding structure 10*b* increases gradually from the top of the airflow guiding structure 10*b* to the bottom of the airflow guiding structure 10*b*, so that the outer surface of the airflow guiding structure 10*b* forms at least one inclined surface and at least one curved surface.

Figure 3C:
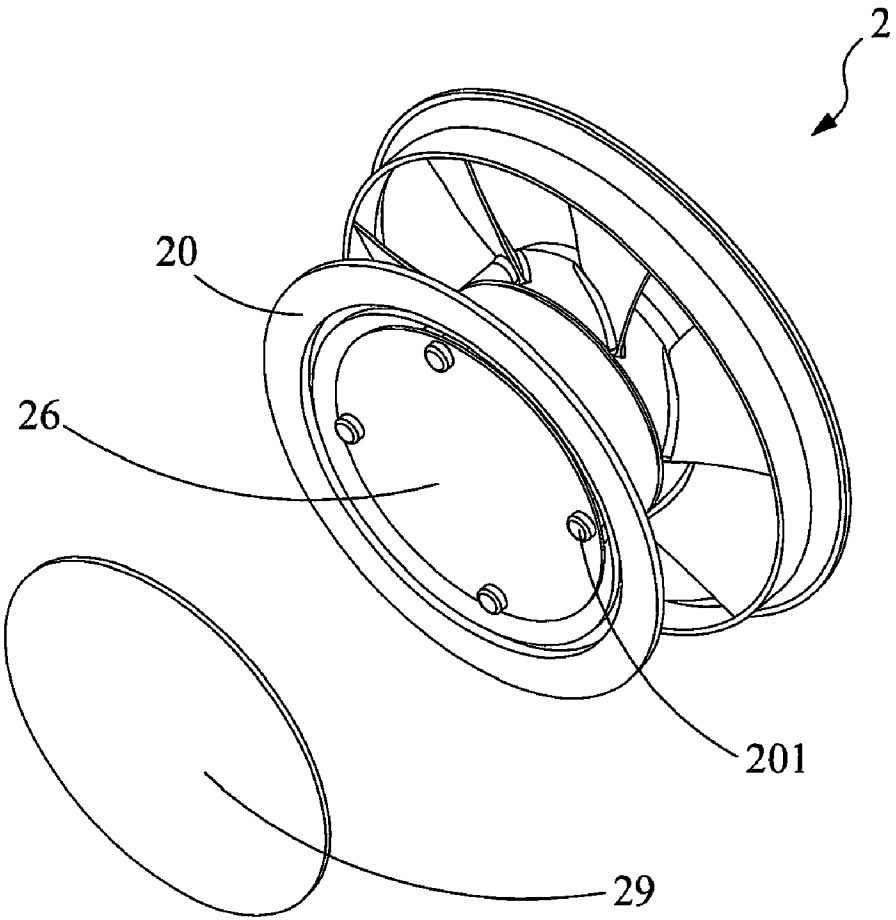
FIG. 3C is a three-dimensional illustration showing a fan according to a second embodiment of the present invention.
Figure 3D:
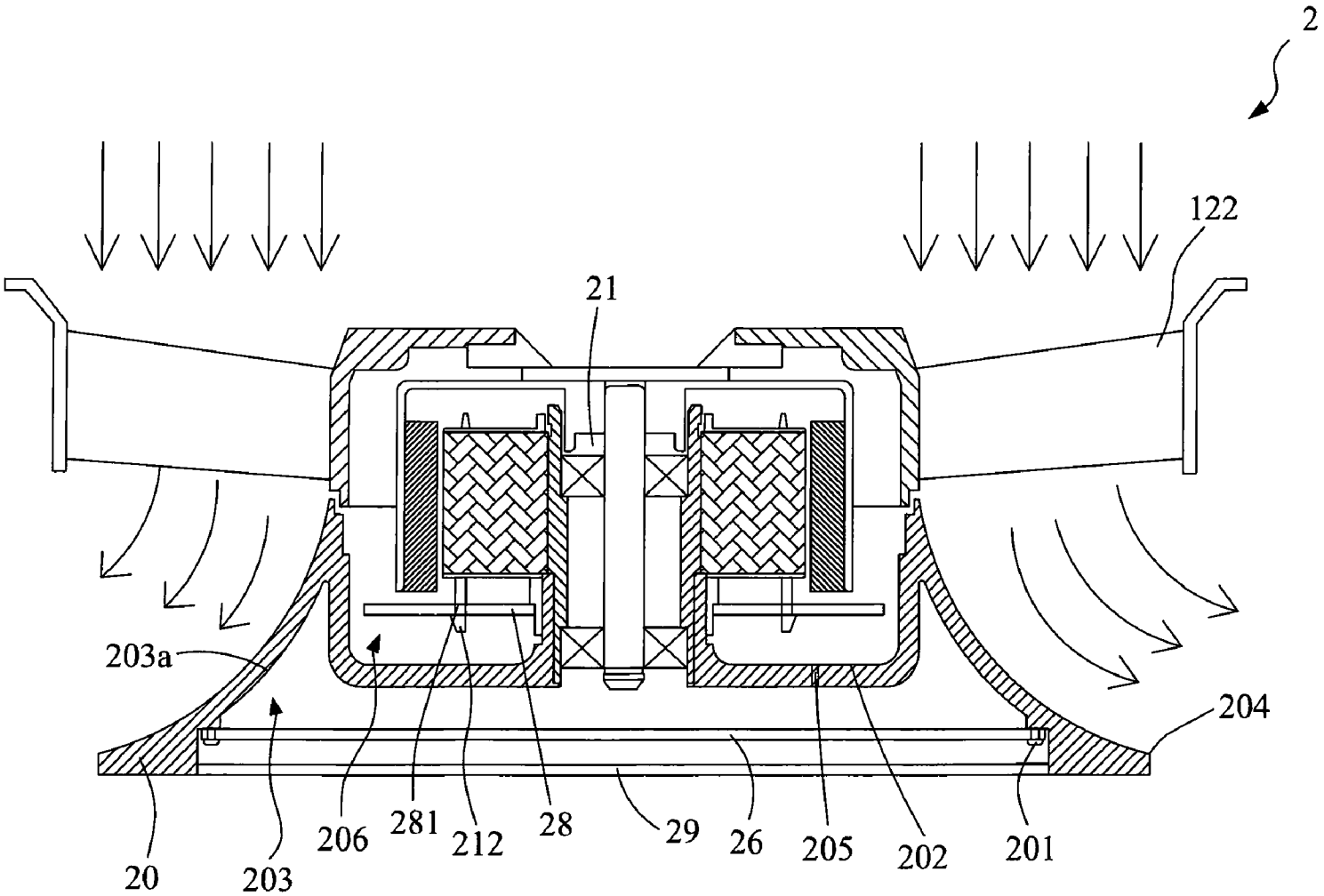
FIG. 3D is a sectional view of the fan of FIG. 3C.

Please refer to FIG. 3C and FIG. 3D, which show a fan 2 according to a second embodiment of the present invention. The difference between the fan 2 of the second embodiment of the present invention and the fan 1 of the first embodiment of the present invention is that the fan 2 further includes a first circuit device 26, a second circuit device 28 and a covering plate 29. A first space 203 is disposed in the airflow guiding structure 20 and close to the bottom 204 of the airflow guiding structure 20, so that the first circuit device 26(*an* inverter, a controller, a rectification circuit, a controlling circuit or a motor driving circuit for example) which is supposed to be disposed outside the fan 2 can be fixed on an inner wall 203*a* of the first space 203 by at least a fixing element 201(*a* screw, a rivet or other elements having the capability of fixing), so as to economize the use of space, and the first circuit device 26 can be protected under the airflow guiding structure 20.

Besides, the top surface 202 of the airflow guiding structure 20 has at least a through hole 205, so that the first circuit device 26 can be electrically connected with the second circuit device 28 or other element through the through hole 205. The covering plate 29 is connected with the bottom of the inner wall 203*a* of the first space 203 of the airflow guiding structure 20, thus the first circuit device 26 disposed in the first space 203 is hidden. In other embodiments, the first circuit device 26 can be fixed on the covering plate 29 by at least a fixing element.

The second circuit device 28 can be a circuit board in this embodiment, and a driving circuit is disposed on the circuit board for driving the motor 21 of the fan 2. A predetermined distance is formed between the bottom of the motor 21 and the top surface 202 of the airflow guiding structure 20, so that a second space 206 is formed between the motor 21 and the airflow guiding structure 20, and the second circuit device 28 is disposed in the second space 206. The circuit board (second circuit device 28) has at least a through hole 281 for connecting with a connecting part 212 of the stator of the motor 21. In other embodiments, the second circuit device 28 can be fixed on the motor 21 by at least a fixing element.

Figure 4A:
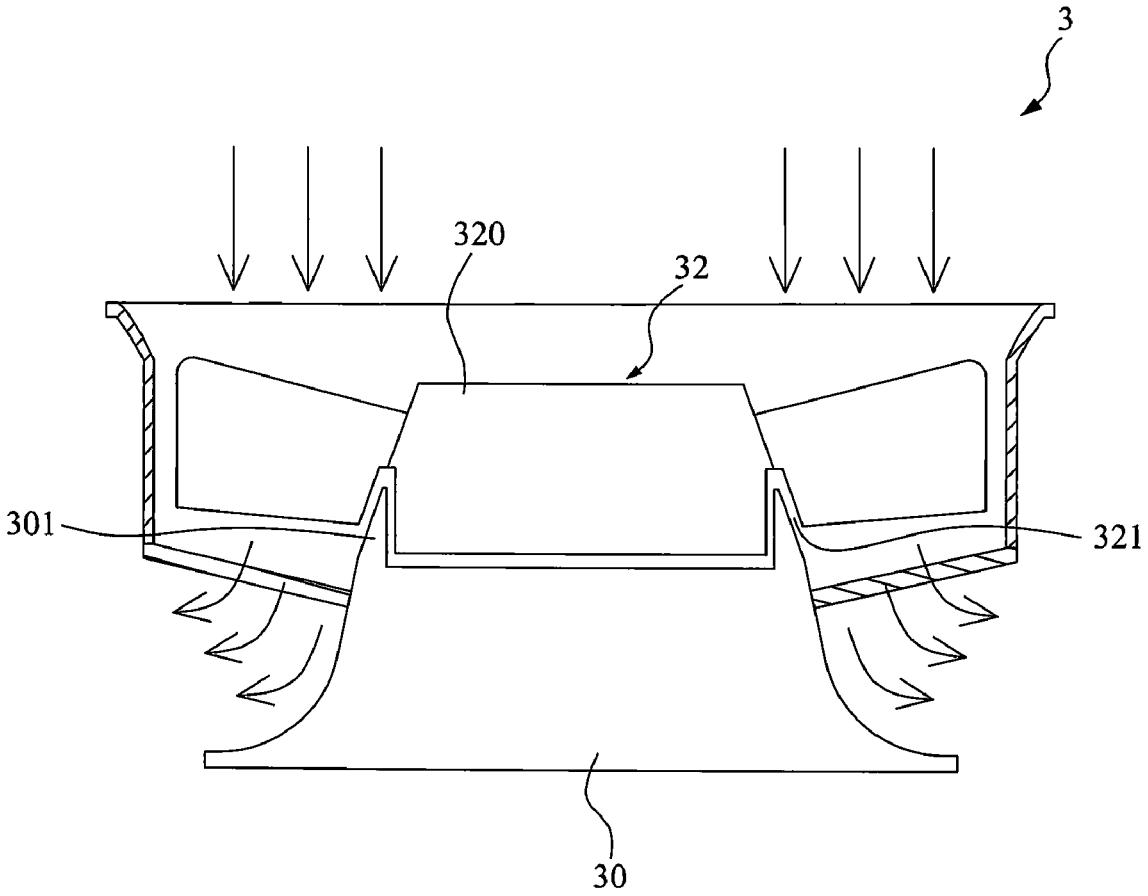
FIG. 4A is a sectional view of a fan according to a third embodiment of the present invention.

Please refer to FIG. 4A, which shows a sectional view of a fan 3 according to a third embodiment of the present invention. The difference between the fan 3 of the third embodiment of the present invention and the fan 1 of the first embodiment of the present invention is that the bottom of the hub 320 has a recess portion 321 for facilitating the molding process. In addition, the top of the airflow guiding structure 30 has a protruding portion 301 disposed corresponding to the recess portion 321 of the hub 320.

Figure 4B:
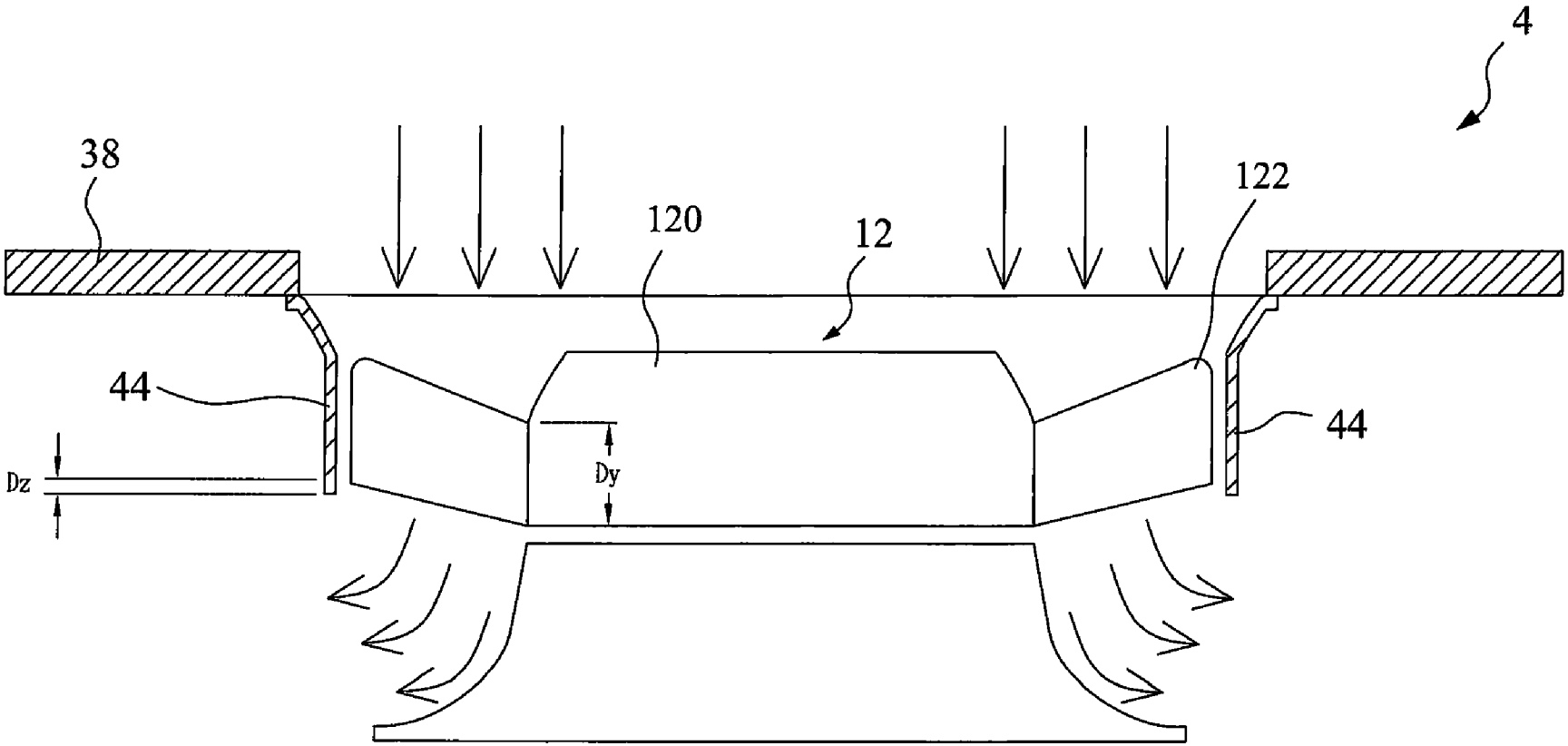
FIG. 4B is a sectional view of a fan according to a fourth embodiment of the present invention.

Please refer to FIG. 4B, which shows a sectional view of a fan 4 according to a fourth embodiment of the present invention. The difference between the fan 4 of the fourth embodiment of the present invention and the fan 1 of the first embodiment of the present invention is that the guiding ring 44 is connected to a module housing 38, so that the guiding ring 44 can be disposed around and adjacent to the impeller 12. The bottom of the guiding ring 44 is arranged adjacent to the bottom of the outer edges of the blades 122. In this case, the bottom of the guiding ring 44 is protruded and exceeding the bottom of the outer edges of the blades 122, and a second predetermined distance "Dz" is defined between the bottom of the guiding ring 44 and the bottom of the outer edges of the blades 122. The ratio of "Dz" to "Dy" ranges from 0 to 0.5.

Figure 4C:
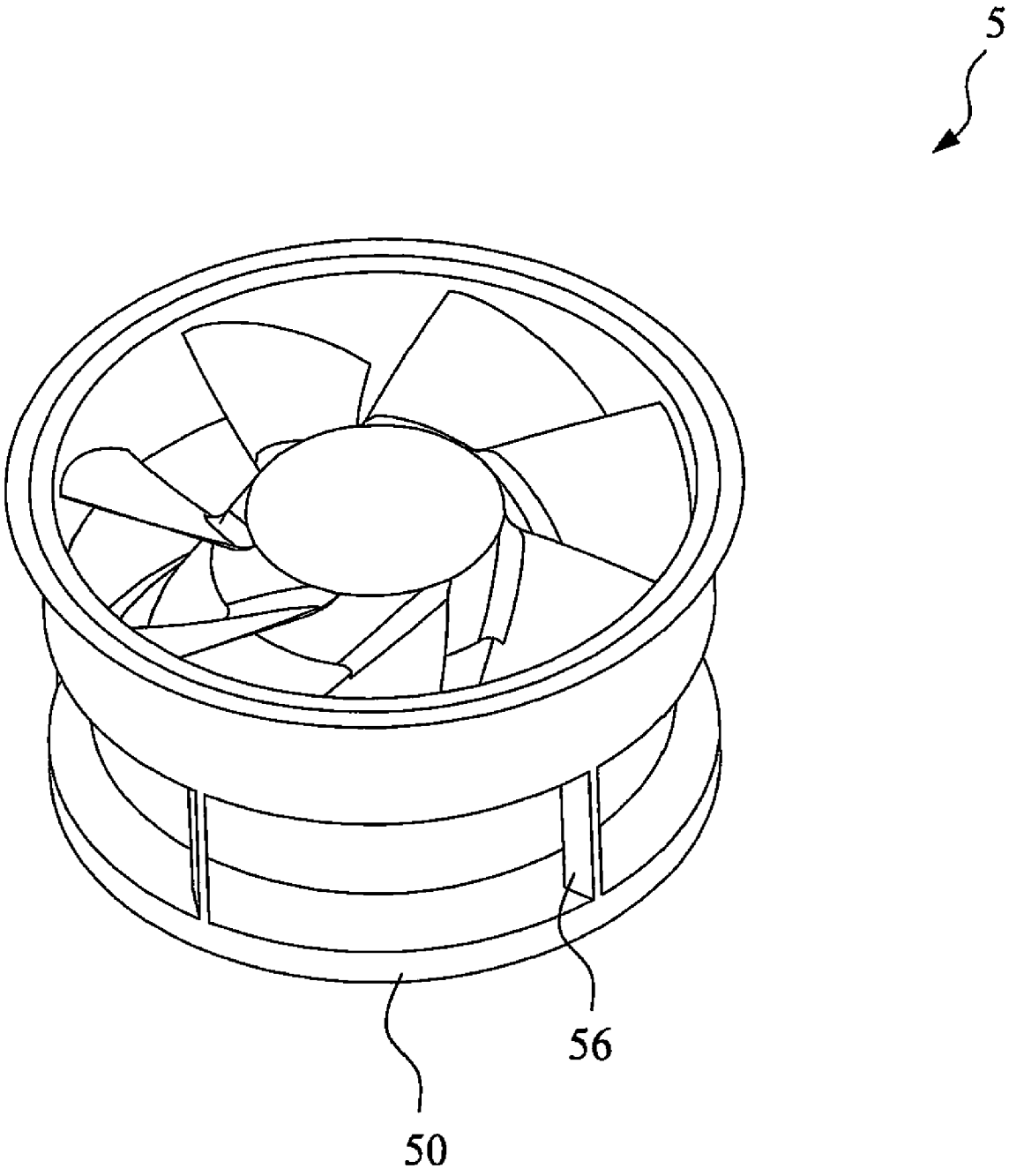
FIG. 4C is a three-dimensional illustration showing a fan according to an fifth embodiment of the present invention.

Please refer to FIG. 4C, which shows a fan 5 according to a fifth embodiment of the present invention. The difference between the fan 5 of the fifth embodiment of the present invention and the fan 1 of the first embodiment of the present invention is that the connecting elements 56 of the fan 5 are connected to the predetermined positions of the outer surface of the bottom of the airflow guiding structure 50, respectively. But in the first embodiment of FIG. 1B, the connecting elements 16 of the fan 1 are connected to the predetermined positions of the outer surface of the top of the airflow guiding structure 10, respectively.

Figure 5A:
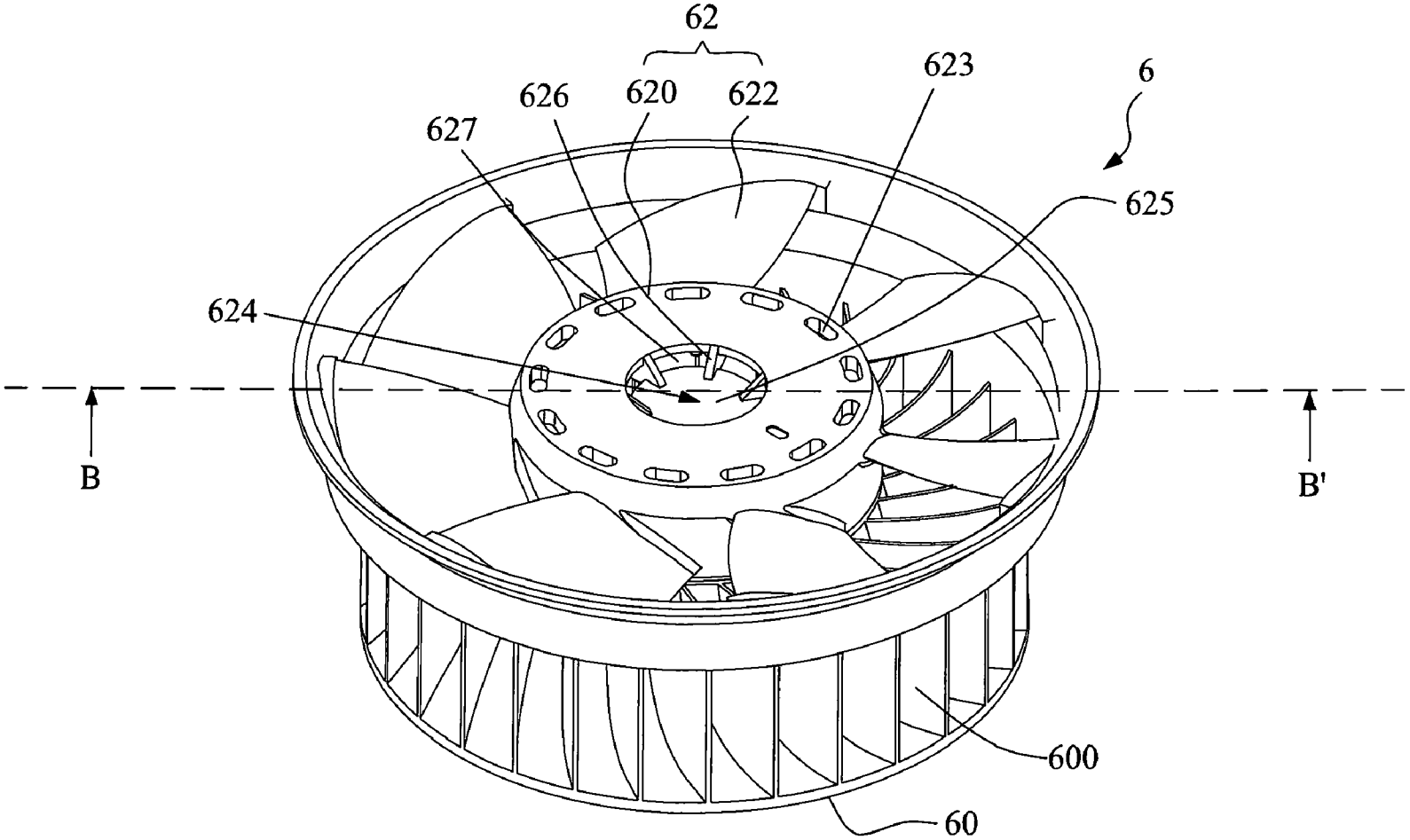
FIG. 5A is a three-dimensional illustration showing a fan according to a sixth embodiment of the present invention.
Figure 5B:
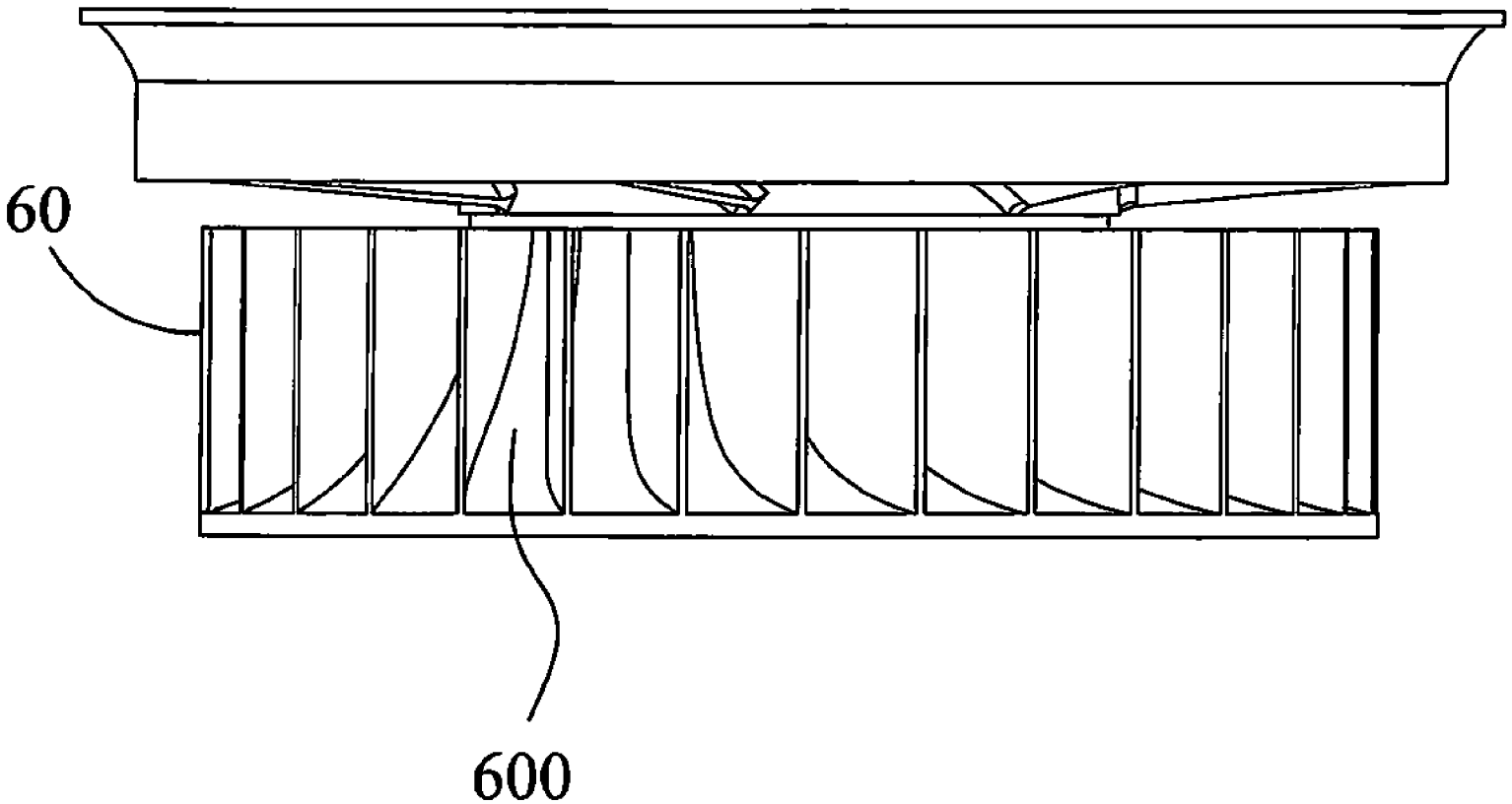
FIG. 5B is a lateral view of the fan of FIG. 5A.
Figure 6C:
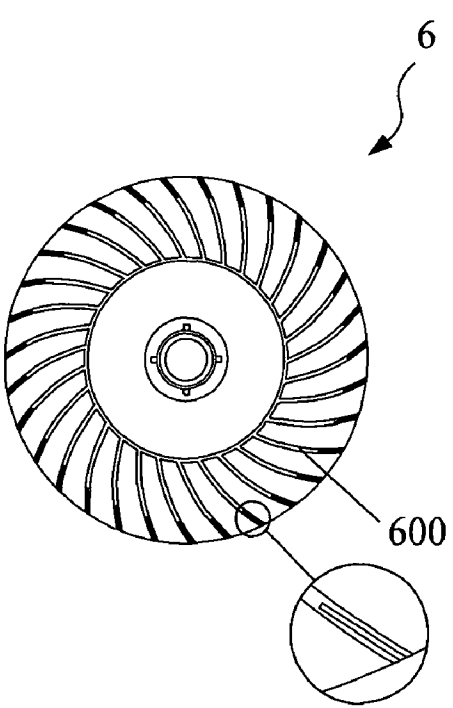
FIG. 6A to FIG. 6C are sectional views showing another three airflow guiding structures according to the present invention.
Figure 6B:
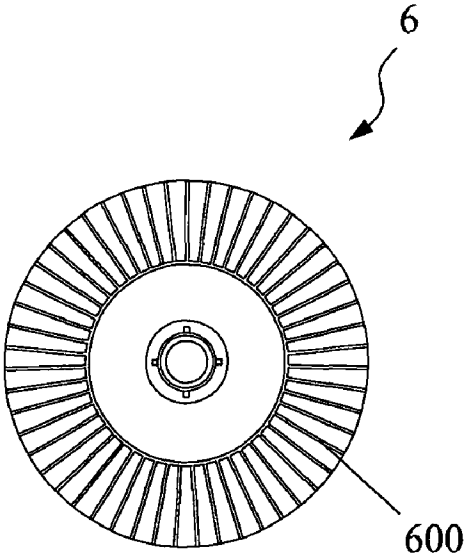
Figure 6A:
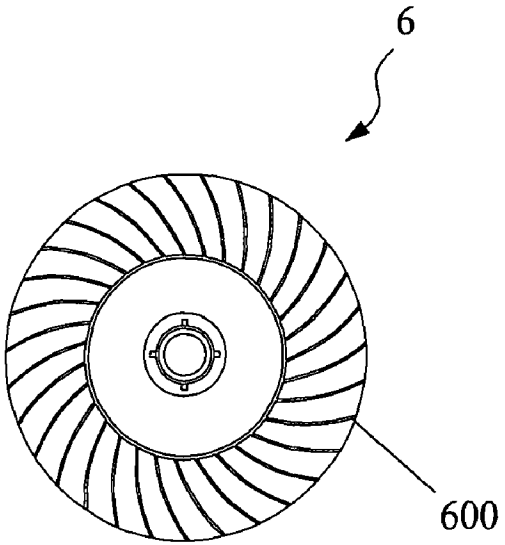

Please refer to FIG. 5A and FIG. 5B, which show a fan 6 according to a sixth embodiment of the present invention. The difference between the fan 6 of the sixth embodiment of the present invention and the fan 1 of the first embodiment of the present invention is that the airflow guiding structure 60 of the fan 6 is composed of a plurality of fins 600 which is made by metal (copper or aluminum for example). The fins 600 are arranged radially, i.e., the gap between two adjacent fins 600 increases gradually from the interior of the airflow guiding structure 60 to the outer edge of the airflow guiding structure 60, and the shape of each fin 600 can be curved or flat, as shown in FIG. 6A and FIG. 6B. Or, a claw portion can be disposed at the outer edge of each fin 600, as shown in FIG. 6C.

Besides, the top surface of the hub 620 of the impeller 62 has a plurality of balance holes 623, so that when the rotation of the impeller 62 is imbalanced, a suitable number of balance materials can be placed in the balance holes 623 according to the rotation status of the impeller 62, so as to avoid the swing of the impeller 62 and make the impeller 62 to rotate stably.

Furthermore, the hub 620 of the fan 6 has an intake 624 located at the center of the top surface of the hub 620. A base 625 and a plurality of ribs 626 are disposed in the intake 624, one end of each rib 626 are disposed around the edge of the intake 624 orderly, and another end of each rib 626 are connected with the base 625, so that the intake 624 is divided into a plurality of openings 627(each opening 627 is formed between two adjacent ribs 626). Therefore, airflows can pass through the openings 627, and heats generated by the motor disposed under the hub 620 can be dissipated.

Figure 7A:
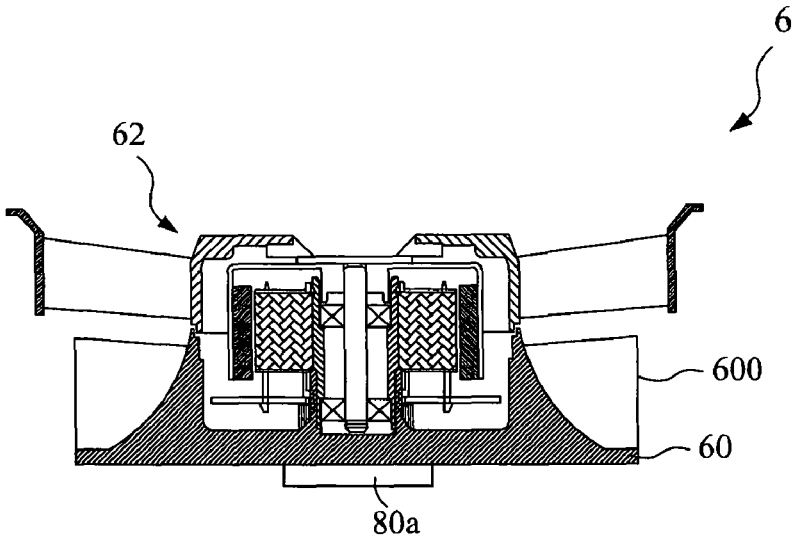
FIG. 7A is a sectional view of the fan along line B-B' of FIG. 5A applied to a heat source.
Figure 7B:
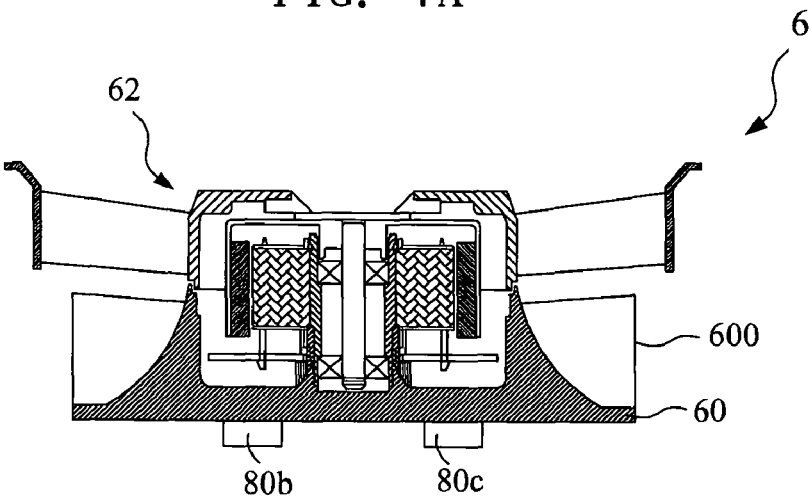
FIG. 7B shows the fan in 5A being applied to two heat source.

Please refer to FIG. 7A and FIG. 7B, FIG. 7A is a sectional view of the fan along line C-C' of FIG. 5A applied to a heat source, and FIG. 7B shows the fan in FIG. 5A being applied to two heat source. In FIG. 7A, the fan 6 is disposed on a heat source 80*a* (a CPU of a host of a computer or other electronic elements such as IC for example), and the bottom surface of the airflow guiding structure 60 is tightly connected with the heat source 80. Because the airflow guiding structure 60 is made of metal and the airflow guiding structure 60 of the fan 6 is composed of a plurality of fins 600, the heats generated by the heat source 80 can be conducted away from the heat source 80 through the airflow guiding structure 60 and its fins 600, then, the heats conducted to the fins 600 will be dissipated when the airflow generated by the rotation of the impeller 62 passes through the fins 600. Therefore, the airflow guiding structure 60 can not only change the direction of the airflow, but also has the capability of heat dissipation. Further, the fan 6 can be designed to meet practical requirements, such as for using onto more than one heat sources. As shown in FIG. 7B, the fan 6 can be disposed on two heat sources 80*b* and 80*c* for dissipating heats generated by these two heat sources 80*b* and 80*c*.

Figure 7C:
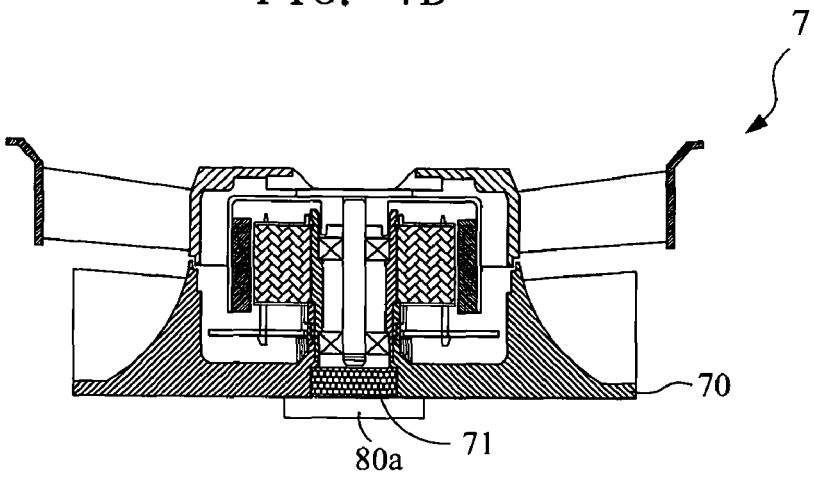
FIG. 7C shows a fan with the airflow guiding structure combined with a metal mass.

Furthermore, please refer to FIG. 7C, the difference between the fan 7 and the fan 6 of the FIG. 7A or FIG. 7B is that the center of the bottom of the airflow guiding structure 70 of the fan 7 is hollow, thus a metal mass 71, which is made of copper or aluminum, can be disposed in the airflow guiding structure 70 by hot plugging. The first step of hot plugging is to heat the airflow guiding structure 70 until the airflow guiding structure 70 at 300 degrees centigrade. Then, place the mass 71 into the expanded airflow guiding structure 70 and cool the airflow guiding structure 70 rapidly, so as to combine the mass 71 and the airflow guiding structure 70 tightly. After the mass 71 is combined in the airflow guiding structure 70, the bottom surface of the mass 71 is flush with the bottom surface of the airflow guiding structure 70, so that the bottom surface of the mass 71 can be tightly connected with the heat source 80.

In summary, the present invention can change the airflow direction of an axial-flow fan by the airflow guiding structure whose outer radius increases gradually from the top of the airflow guiding structure to the bottom of the airflow guiding structure. Furthermore, the present invention also keeps the advantages of the conventional axial-flow fan, such as low noise, large quantity of exiting airflow and high heat-dissipation efficiency.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

an airflow guiding structure whose an outer radius increases gradually from a top of the airflow guiding structure to a bottom of the airflow guiding structure;

an impeller disposed on the airflow guiding structure and the impeller comprising a hub and a plurality of blades disposed around the hub;

a motor disposed in the hub;

a circuit board for driving the motor, wherein the circuit board and at least a portion of the motor are disposed in an accommodating space formed inside the airflow guiding structure; and a guiding ring connected to a module housing or connected to the airflow guiding structure via at least one connecting element, wherein a predetermined distance is arranged between an inner surface of the guiding ring and outer edges of the blades, an inlet is formed at a top of the guiding ring, an outlet is formed between a bottom of the guiding ring and an outer surface of a sidewall of the airflow guiding structure, a first predetermined distance is defined between the top of the guiding ring and a top of the blades, and a ratio of the first predetermined distance to the length of a conjunction of the blades and the hub ranges from 0.3 to 1;

wherein when the impeller rotates, an airflow enters the fan from the inlet and flows along the outer surface of the sidewall of the airflow guiding structure, then the airflow exits the fan through the outlet, and a direction of the airflow passing through the outlet is different from a direction of the airflow passing through the inlet.

2. The fan according to claim 1, wherein the direction of the airflow passing through the inlet is roughly perpendicular to the entering direction of the airflow passing through the outlet, and the fan is an axial-flow fan.

3. The fan according to claim 1, wherein the outer surface of the airflow guiding structure forms at least one curved surface and/or at least one inclined surface.

4. The fan according to claim 1, wherein a diameter of the guiding ring decreases gradually from the top of the guiding ring to a portion of the guiding ring adjacent to the top of the blades.

5. The fan according to claim 1, wherein the bottom of the guiding ring is arranged adjacent to a bottom of the outer edges of the blades, or the bottom of the guiding ring is protruded and exceeding the bottom of the outer edges of the blades, and a second predetermined distance is defined between the bottom of the guiding ring and the bottom of the outer edges of the blades, and a ratio of the second predetermined distance to the length of a conjunction of the blades and the hub ranges from 0 to 0.5.

6. The fan according to claim 1, wherein an outer radius of the hub increases gradually from a top of the hub to a center of the hub, so that the outer surface of the hub forms at least one curved surface or at least one inclined surface.

7. The fan according to claim 1, wherein an outer radius of the hub increases gradually from a top of the hub to a bottom of the hub, so that the outer surface of the hub forms at least one curved surface or at least one inclined surface.

8. The fan according to claim 7, wherein the bottom of the hub has a recess portion, and the top of the airflow guiding structure has a protruding portion disposed corresponding to the recess portion of the hub.

9. The fan according to claim 1, wherein a ratio of the outer radius of the bottom of the airflow guiding structure to the outer radius of a bottom of the hub ranges from 1.3 to 3.

10. The fan according to claim 1, wherein the airflow guiding structure further comprises a plurality of fins, and fins are arranged radially.

11. The fan according to claim 10, wherein the fin comprises a curved surface or a claw portion, and a material of the airflow guiding structure comprises metal, copper or aluminum.

12. The fan according to claim 1, wherein the fan further comprises a metal mass disposed in the airflow guiding structure.

13. The fan according to claim 1, wherein the airflow guiding structure further comprises a first space disposed in the airflow guiding structure, the fan further comprises a first circuit device disposed in the first space of the airflow guiding structure, and the first circuit device is a rectification circuit, a controlling circuit or a motor driving circuit.

14. The fan according to claim 13, wherein a top surface of the airflow guiding structure comprises at least a through hole, and the first circuit device is electrically connected with an electric element through the through hole.

15. The fan according to claim 13, wherein the first circuit device is fixed on an inner wall of the first space of the airflow guiding structure by at least a fixing element, and the fixing element is a screw, a rivet or other elements having the capability of fixing.

16. The fan according to claim 13, further comprising a covering plate connected with a bottom of an inner wall of the first space of the airflow guiding structure, and the first circuit device is fixed on the covering plate by at least a fixing element.

17. An airflow guiding structure applied to an axial-flow fan, the axial-flow fan comprising an impeller, a circuit board, a motor and a guiding ring, the impeller comprising a hub and a plurality of blades disposed around the hub, wherein:

the airflow guiding structure is disposed underneath the impeller, an outer radius of the airflow guiding structure increases gradually from a top of the airflow guiding structure to a bottom of the airflow guiding structure, the guiding ring is connected to a module housing or connected to the airflow guiding structure via at least one connecting element, a predetermined distance is arranged between an inner surface of the guiding ring and outer edges of the blades, an inlet is formed at a top of the guiding ring, an outlet is formed between a bottom of the guiding ring and an outer surface of a sidewall of the airflow guiding structure, and a first predetermined distance is defined between the top of the guiding ring and a top of the blades, and a ratio of the first predetermined distance to the length of a conjunction of the blades and the hub ranges from 0.3 to 1; when the impeller rotates, the airflow enters the fan from the inlet and flows along the outer surface of the sidewall of the airflow guiding structure, then the airflow exits the fan through the outlet, and a direction of the airflow passing through the outlet is different from a direction of the airflow passing through the inlet;

wherein the circuit board and at least a portion of the motor are disposed in an accommodating space formed inside the airflow guiding structure.

18. The airflow guiding structure according to claim 17, wherein the direction of the airflow passing through the inlet is roughly perpendicular to the direction of the airflow passing through the outlet.

19. A fan, comprising:

an airflow guiding structure whose outer radius increases from a top of the airflow guiding structure to a bottom of the airflow guiding structure;

an impeller disposed on the airflow guiding structure and comprising a hub and a plurality of blades disposed around the hub;

a motor disposed in the hub;

a covering plate connected with the airflow guiding structure;

a circuit board for driving the motor, wherein the circuit board is disposed in an accommodating space formed inside the airflow guiding structure and closed via the covering plate; and a guiding ring connected to a module housing or connected to the airflow guiding structure via at least one connecting element, wherein an inlet is formed at a top of the guiding ring, and an outlet is formed between a bottom of the guiding ring and an outer surface of a sidewall of the airflow guiding structure;

wherein when the impeller rotates, an airflow enters the fan from the inlet and flows along the outer surface of the sidewall of the airflow guiding structure, then the airflow exits the fan through the outlet, and a direction of the airflow passing through the outlet is different from a direction of the airflow passing through the inlet.

* * * * *